United States Patent [19]

Zoschak et al.

[11] Patent Number: 4,466,082

[45] Date of Patent: Aug. 14, 1984

[54] APPARATUS FOR MIXING AND DISTRIBUTING SOLID PARTICULATE MATERIAL

[75] Inventors: Robert J. Zoschak, Rutherford; Bimal K. Biswas, Union, both of N.J.

[73] Assignee: Foster Wheeler Energy Corporation, Livingston, N.J.

[21] Appl. No.: 345,120

[22] Filed: Feb. 2, 1982

[51] Int. Cl.[3] ..... B01F 13/02

[52] U.S. Cl. ..... 366/101; 366/136; 366/341

[58] Field of Search ..... 366/101, 136, 106, 137, 366/107, 9, 177, 183, 341; 34/57 A; 406/138

[56] References Cited

U.S. PATENT DOCUMENTS

| | | | |
|---|---|---|---|
| 3,106,385 | 10/1963 | Arthur et al. | 366/101 X |
| 3,258,252 | 6/1966 | Lanier | 366/107 |
| 3,361,413 | 1/1968 | Heyl | 366/137 |
| 3,627,555 | 12/1971 | Driscoll | 366/101 X |
| 3,647,188 | 3/1972 | Solt | 366/107 |

FOREIGN PATENT DOCUMENTS

| | | | |
|---|---|---|---|
| 736377 | 6/1966 | Canada | 366/107 |

*Primary Examiner*—Timothy F. Simone

*Attorney, Agent, or Firm*—Marvin A. Naigur; John E. Wilson; Warren B. Kice

[57] ABSTRACT

An apparatus and method for mixing and distributing solid material in which the material is continuously introduced into a vessel and a pressurized gas is introduced into the lower portion of the vessel at a velocity sufficient to pass upwardly through the material in the vessel to promote mixing of the material. A plurality of outlets are disposed in an angularly spaced relation along the vessel for permitting the material to continuously discharge to a plurality of selected locations. The excess gas in the vessel is removed, cleaned and introduced back into the vessel.

15 Claims, 6 Drawing Figures

APPARATUS FOR MIXING AND DISTRIBUTING SOLID PARTICULATE MATERIAL

BACKGROUND OF THE INVENTION

This invention relates to a mixing and distributing apparatus and method, and more particularly to such an apparatus and method in which one or more materials are mixed in a vessel and distributed from the vessel.

The use of fluidized beds has long been recognized as an attractive way of generating heat. In these type of arrangements, a particulate material, including a mixture of fuel material, such as coal, and an adsorbent material for the sulfur released as a result of the combustion of the fuel material, are disposed on a grate or grate-like plate. Air is passed through the bed to fluidize the material so that the bed behaves as a boiling liquid which promotes the combustion of the fuel.

with the present invention when taken in conjunction with the accompanying drawings in which.

Figure 1:
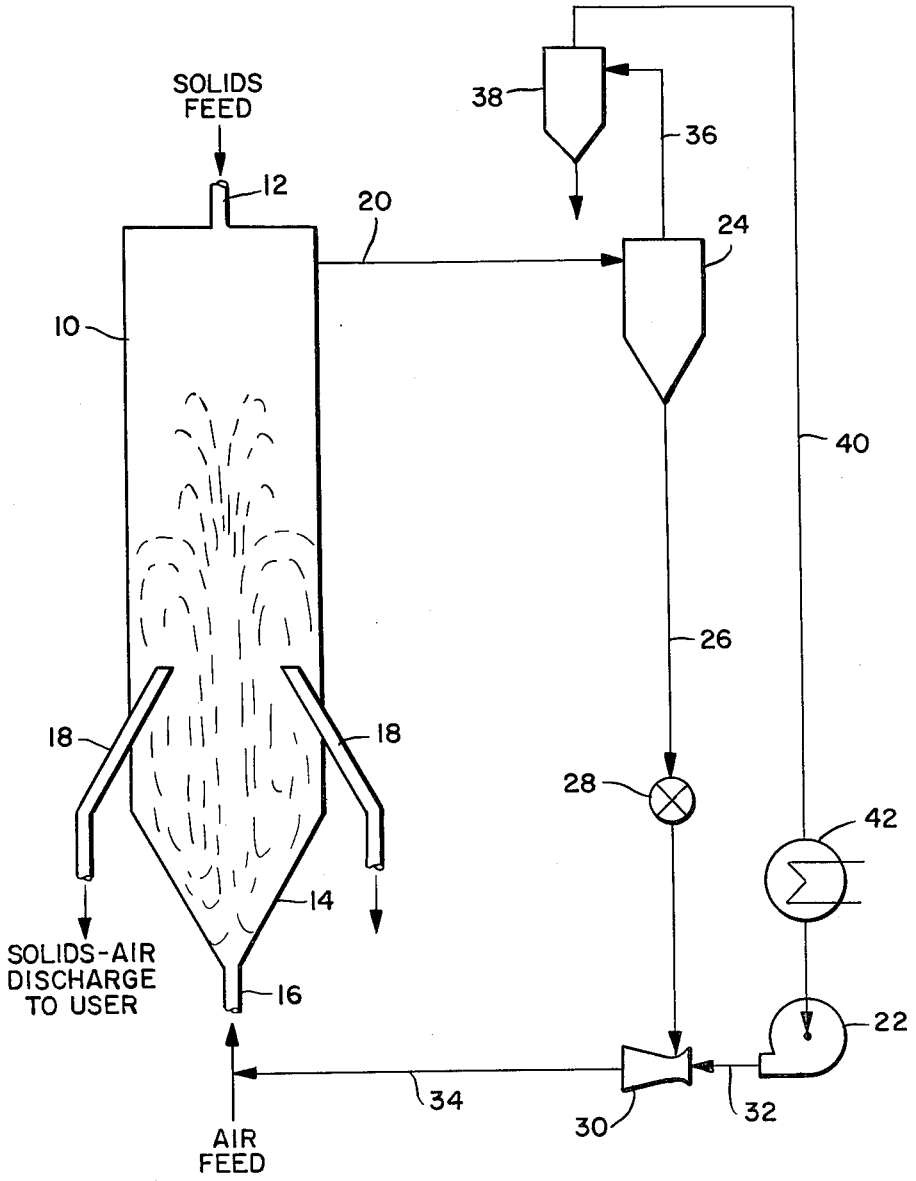
FIG. 1 is a schematic view of the system of the present invention.

DESCRIPTION OF THE PREFERRED EMBODIMENTS a line 34, to the inlet 16 of the vessel 10. The rotary valve 28 functions as a seal to prevent backflow of air from the high pressure side of the blower 22 to the low pressure zone in the separating device 24.

The air outlet of the separating device 24 is connected, via a line 36, to a second-stage separating device 38 which also can be in the form of a cyclone separator. Although not shown in the drawings, it is understood that the solids outlet from the separating device 38 can be discharged to another vessel or the like.

The air outlet from the separating device 38 is connected, via a line 40, back to the inlet side of the recirculation blower 22 for injection back into the system. Thus, the suction from the blower 22 draws the air from the vessel 10, through the separators 24 and 38 and to the blower 22. A heat exchanger 42 can be provided in the line 40 to cool the recycled air passing through the latter line, especially if the heat removed with the air-solids mixture from the vessel 10 is not sufficient to compensate for the heat added by the recirculation blower 22 without excessive temperature buildup in the bed in the vessel 10.

Figure 2:
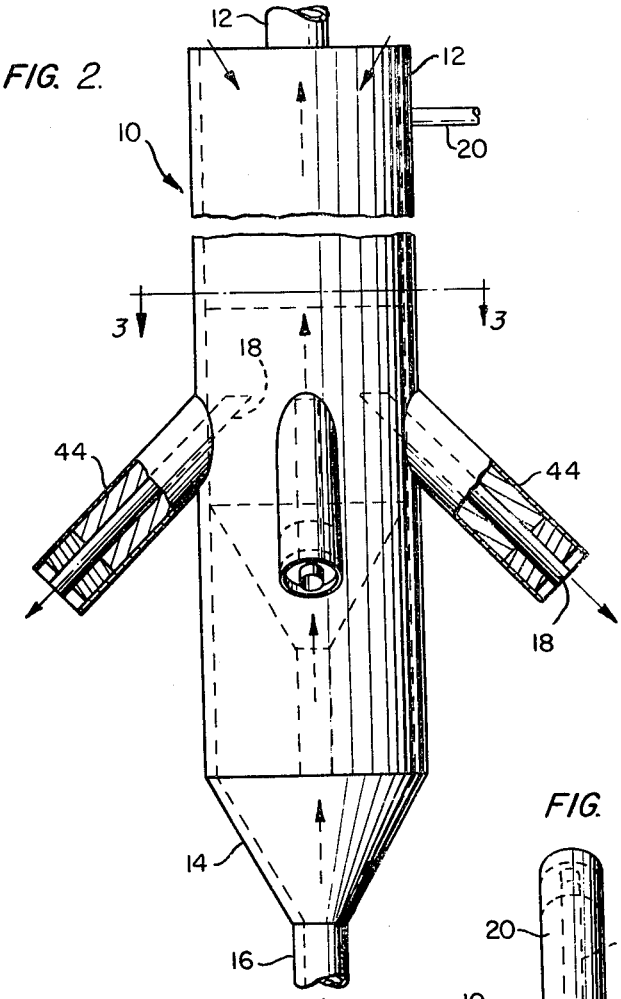
FIG. 2 is a front elevational view, partially in section, of the mixing and distributing apparatus of the system of FIG. 1.
Figure 3:
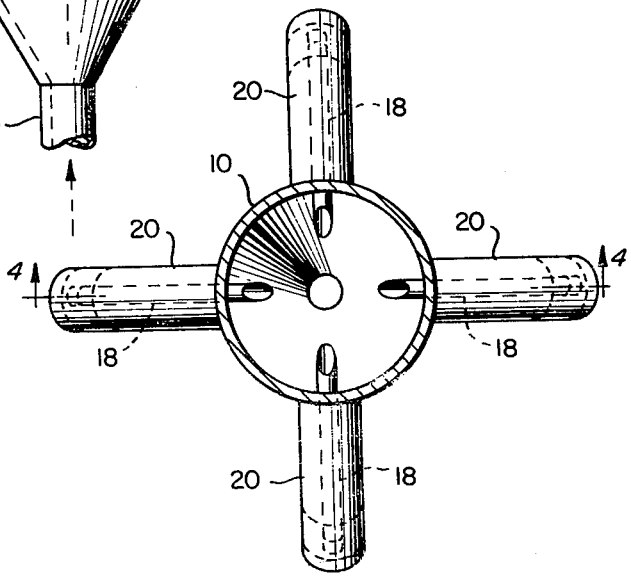
FIG. 3 is a cross-sectional view taken along the line 3—3 of FIG. 2.
Figure 4:
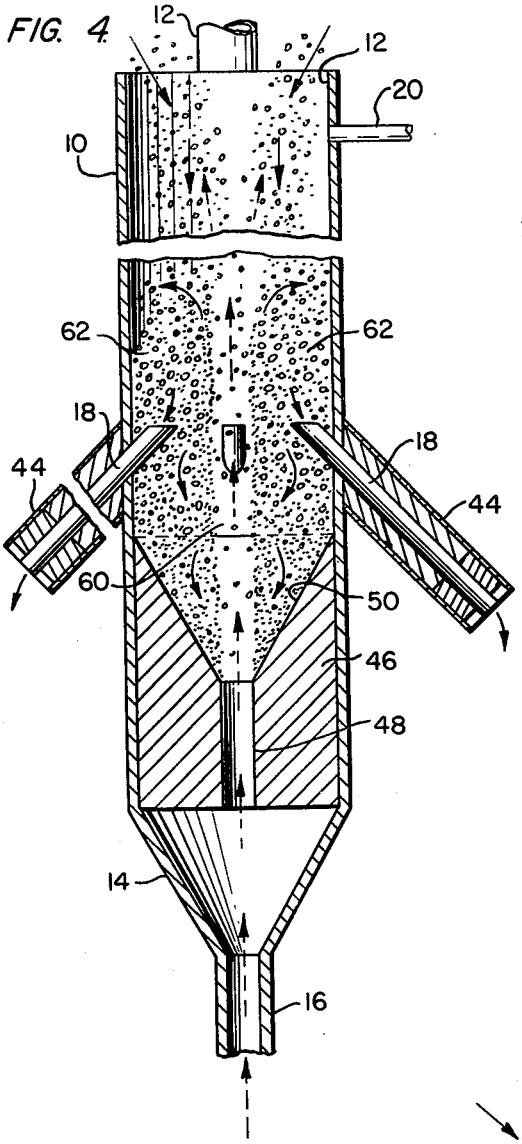
FIG. 4 is a vertical cross-sectional view taken along the line 4—4 of FIG. 3.

FIGS. 2–4 depict the specifics of the vessel 10 in more detail. More particularly, it is noted that four outlet pipes 18 extend from the vessel and are covered by a refractory material 44. As better shown in FIG. 4, a filler plug 46 is provided in the vessel immediately above the hopper portion 14 and has a central bore 48 through which the air from the inlet 16 passes, which bore widens out into a substantially conical shaped opening 50 which receives the material flowing downwardly in the vessel. As a result of this flow of the air through the material, a central zone, shown in general by the reference numeral 60 is formed which is concentric with the axis of the vessel 10 and in which the concentration of the particles is low and the general movement of the particles is upward. An annular zone 62 is also formed which extends around the central zone 60 and in which the concentration of the particles is high and the general movement is downward. The central zone 60 is continually supplied with particles from the annular zone 62 in the vicinity of the opening 50 which particles are thus transported to the upper part of the bed by means of the pressurized air and then fall back down into the annular zone 62 and repeat the cycle. As a result, a thorough mixing of the particles within the bed is achieved.

During movement of the particles in the annular zone 62 downwardly, a portion will enter the upper end of the discharge pipe 18 and be transported, by gravity, through the entire length of the pipes to areas external of the vessel 10. In the present embodiment in which four such pipes 18 are provided, it can be appreciated that a precise distribution of the mixed particles into four separate locations is thus achieved. In the case of a fluidized bed discussed above, a ducting system, or the like, can be provided to connect the outlet ends of the pipes 18 to the feeders associated with the walls of the vessel housing the fluidized bed.

Of course, the supply of new particulate material to the inlet 12 of the vessel 10 is regulated according to the discharge from the pipes 18 so that a continuous replenishing of the particle material in the vessel 10 is achieved.

Of course, the excess air (usually in excess of 90% of the air discharged from the pipes 18) passes upwardly into the upper portion of the vessel and out through the line 20 for treatment and recirculation by the separating device 24, the blower 22, etc., as described above.

Figure 6:
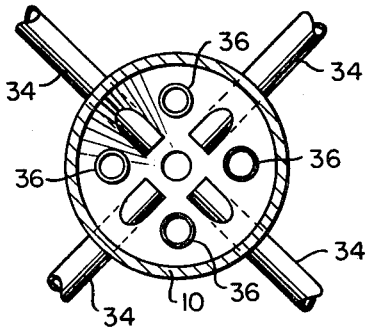
FIG. 6 is a horizontal cross-sectional view taken along the line 6—6 of FIG. 5.
Figure 5:
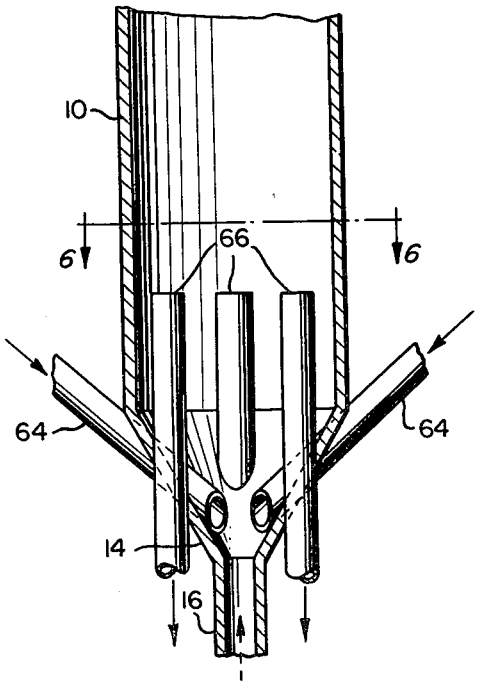
FIG. 5 is a view similar to FIG. 4 but depicting an alternate embodiment of the apparatus of the present invention.

An alternative embodiment of the vessel 10 is depicted in FIGS. 5 and 6 and includes identical components of the latter vessel which are given the same reference numerals, with the particulate material being omitted from the drawings in the interest of clarity. In this embodiment, the filler plug 46 of the previous embodiment is omitted and four equiangularly spaced inlet pipes 64 are provided which extend through the wall of the hopper portion 14 of the vessel and at an angle to the horizontal. The pipes 64 receive the particulate material from one or more sources as in the previous embodiment and feed the material into the lower portion of the hopper 14 immediately above the air inlet 16.

A central zone and an annular zone are thus formed and the flow pattern of the material in the vessel is the same as discussed in connection with the previous embodiment.

Four vertically extending, angularly spaced, discharge pipes 66 extend from a point inside the vessel 10, and through the inclined walls of the hopper 14 for discharging the particulate material to four separate external locations in a manner similar to that in connection with the embodiments of FIGS. 2–4. Of course, the vessel of the embodiment of FIGS. 5 and 6 can be used with the recirculating, separating and reinjecting apparatus depicted in FIG. 1.

It is thus seen that, as a result of the foregoing, a precise mixing and distribution of the particulate material from one or more sources to a plurality of discharge points is achieved in a relatively simple and efficient manner while the excess air from the vessel is used in an efficient manner.

It is noted that several variations may be made in the foregoing. For example, if the vessel 10 is operated at, or near, atmospheric pressure, the recycled air line 40 (FIG. 1) and the heat exchanger 42 can be omitted, and the air leaving the second-stage separating device 38 can be discharged to atmosphere and the blower 22 can take suction from the atmosphere.

As will be apparent to those skilled in the art, various changes and modifications may be made to the apparatus of the present invention without departing from the spirit and scope of the present invention as recited in the appended claims and their legal equivalent.

What is claimed is:

1. An apparatus for mixing and distributing solid particulate material, said apparatus comprising a vessel for supporting a bed of said material, inlet means associated with said vessel for receiving additional material for said bed, means for introducing a pressurized gas into the lower portion of said vessel at a velocity sufficient to pass through the central portion of said bed and cause a spouting of said particles from the upper surface of said bed and forming a central zone in which the concentration of particles in the gas is relatively low and said particles move upwardly with the gas, and an outer zone surrounding said central zone in which the concentration of said particles is relatively high and their general movement is downwardly, a plurality of outlets disposed in a spaced relation around said vessel and communicating with said outer zone for permitting said mixed material to discharge from a plurality of areas of said vessel, outlet means for permitting said gas to discharge from the upper portion of said vessel, means connected to said gas outlet means for separating from said gas the solid particles entrained in said gas and means for injecting said solid particles back into said bed.

2. The apparatus of claim 1 wherein each of said outlet means is in the form of a pipe extending from said outer zone, through said vessel and to an area external of said vessel.

3. The apparatus of claim 2 wherein said vessel has a generally cylindrical shape and wherein said pipes extend through circumferentially spaced openings extending through said vessel.

4. The apparatus of claim 1 wherein said separating means comprises a cyclone separator.

5. The apparatus of claim 1 wherein said injecting means comprises an injecting nozzle, and a blower connected to the inlet of said injecting nozzle.

6. The apparatus of claim 5 further comprising a second-stage separating means connected between the gas outlet means of said separating means and said blower.

7. The apparatus of claim 5 further comprising means connecting said blower to the gas outlet of said separating means for injecting the clean gas from said separating means to said nozzle.

8. The apparatus of claim 6 further comprising means connecting said blower to the gas outlet of said second-stage separating means for injecting the clean gas from said second-stage separating means to said nozzle.

9. The apparatus of claim 7 or 8 further comprising a heat exchanger connected to said connecting means.

10. The apparatus of claim 2 wherein said pipes extend at an angle relative to the axis of said vessel.

11. The apparatus of claim 2 wherein said pipes extend parallel to the axis of said vessel.

12. The apparatus of claim 1 wherein said inlet means for said material is located in the upper portion of said vessel.

13. The apparatus of claim 1 wherein the inlet means for said material is located in the lower portion of said vessel.

14. The apparatus of claim 1 wherein the inlet means for said material is in the form of a plurality of spaced pipes extending through said vessel at an angle relative to the axis of said vessel and communicating with the lower portion of said vessel.

15. The apparatus of claim 1 further comprising means disposed in said vessel for defining a conical hopper portion in said vessel, said gas introducing means registering with the apex of said hopper portion.

* * * * *